US006769282B2

(12) United States Patent
Henden

(10) Patent No.: US 6,769,282 B2
(45) Date of Patent: Aug. 3, 2004

(54) ONE-STEP OFFSET BENDER

(75) Inventor: Dennis Scott Henden, Kingston, WA (US)

(73) Assignee: Henden Industries, Inc., Kingston, WA (US)

( * ) Notice: Subject to any disclaimer, the term of this patent is extended or adjusted under 35 U.S.C. 154(b) by 0 days.

(21) Appl. No.: 10/439,407

(22) Filed: May 15, 2003

(65) Prior Publication Data

US 2003/0213279 A1 Nov. 20, 2003

Related U.S. Application Data

(60) Provisional application No. 60/411,573, filed on Sep. 17, 2002, and provisional application No. 60/381,744, filed on May 17, 2002.

(51) Int. Cl.[7] ..... B21D 11/04

(52) U.S. Cl. ..... 72/383; 72/458; 72/459; 72/306

(58) Field of Search ..... 72/383, 384, 458, 72/459, 306

(56) References Cited

U.S. PATENT DOCUMENTS

| | | | | |
|---|---|---|---|---|
| 799,670 A | | 9/1905 | Reynolds | |
| 1,816,218 A | | 7/1931 | Henry et al. | |
| 1,910,769 A | | 5/1933 | Jaynes | |
| 2,273,655 A | | 2/1942 | Olsen | |
| 2,414,926 A | * | 1/1947 | Burke | 72/217 |
| 2,604,924 A | | 7/1952 | Blake et al. | |
| 2,697,469 A | | 12/1954 | Becroft | |
| 2,708,471 A | | 5/1955 | Ballard | |
| 2,893,461 A | | 7/1959 | Pauling | |
| 2,998,838 A | | 9/1961 | Byrd, Jr. | |
| 3,075,568 A | | 1/1963 | Bright | |
| 3,385,092 A | | 5/1968 | Scott | |
| 3,396,565 A | | 8/1968 | Miller | |
| 3,438,237 A | * | 4/1969 | Sisler | 72/387 |
| 3,456,468 A | | 7/1969 | Crippen | |
| 3,557,586 A | | 1/1971 | Zmuda | |
| 3,606,786 A | * | 9/1971 | Taylor | 72/459 |
| 3,662,581 A | | 5/1972 | Early | |
| 3,691,815 A | | 9/1972 | Deacon | |
| 3,731,513 A | | 5/1973 | Kindermann et al. | |
| 3,760,626 A | | 9/1973 | Sharar | |
| 3,803,893 A | * | 4/1974 | Peddinghaus et al. | 72/217 |
| 3,842,648 A | | 10/1974 | Schwartz | |
| 3,855,838 A | | 12/1974 | Jackson | |
| 3,976,388 A | | 8/1976 | Webb | |
| 4,031,733 A | | 6/1977 | Coody | |
| 4,056,960 A | | 11/1977 | Kawanami | |
| 4,061,005 A | | 12/1977 | Kawanami et al. | |
| 4,063,444 A | | 12/1977 | Vecho, Jr. | |
| 4,195,506 A | | 4/1980 | Kawanami et al. | |
| 4,196,610 A | | 4/1980 | Chilton | |

(List continued on next page.)

*Primary Examiner*—David Jones
(74) *Attorney, Agent, or Firm*—Christensen O'Connor Johnson Kindness PLLC

(57) ABSTRACT

One-step offset bender for speed and accuracy in offsetting pipe or other materials. The offset bender (100) includes a base (110) on which is mounted a fixed shoe support (130) and a traveling shoe support (160). The fixed shoe support fixedly holds a first shoe assembly (200), and the traveling shoe support holds a second shoe assembly (200') that can be moved vertically and horizontally. The offset bender simultaneously produces two, aligned, equal and opposite bends in conduit by pressing down on the second shoe assembly (200'). The conduit shoe assemblies include a plurality of conduit shoes that can be selectively aligned to accommodate the desired conduit. The fixed shoe support is pivotally attached to the base, and the traveling shoe support is removable, such that the bender may be folded for easy transport. A motor (361) or other power system may be used to facilitate making the bend.

24 Claims, 9 Drawing Sheets

U.S. PATENT DOCUMENTS

| | | | | | |
|---|---|---|---|---|---|
| 4,269,056 | A | | 5/1981 | Kozinski | |
| 4,351,178 | A | | 9/1982 | Uehara et al. | |
| 4,403,496 | A | | 9/1983 | Kowal | |
| 4,412,442 | A | | 11/1983 | Kawanami et al. | |
| 4,424,699 | A | | 1/1984 | Peppers | |
| 4,596,128 | A | | 6/1986 | Ringersma et al. | |
| 4,597,279 | A | * | 7/1986 | Lisec | 72/388 |
| 4,798,073 | A | * | 1/1989 | Dischler | 72/387 |
| 4,829,806 | A | | 5/1989 | Wright | |
| 4,890,469 | A | * | 1/1990 | Dischler | 72/388 |
| 4,926,672 | A | | 5/1990 | Swanson | |
| 5,222,384 | A | | 6/1993 | Evans | |
| 5,697,240 | A | | 12/1997 | Parker | |
| 5,934,132 | A | | 8/1999 | Nichol | |
| 6,128,944 | A | * | 10/2000 | Haynes | 72/458 |
| 6,457,344 | B2 | * | 10/2002 | Godin | 72/458 |

* cited by examiner

ONE-STEP OFFSET BENDER

CROSS-REFERENCE TO RELATED APPLICATIONS

This application also claims the benefit of Provisional Applications No. 60/411,573, filed Sep. 17, 2002, and No. 60/381,744, filed May 17, 2002, the benefit of which is hereby claimed under 35 U.S.C. § 119.

FIELD OF THE INVENTION

The present invention relates generally to offset benders and, more specifically, to one-step offset benders for pipe and other materials.

BACKGROUND OF THE INVENTION

Conduit bending is one of the fundamental tasks of the electrical construction industry. For example, conventional electrical wiring installations may use EMT (electrical metallic tubing), galvanized steel conduit, or intermediate conduit for protecting runs of wiring. Installation of the conduit generally requires following a path that may be irregular and may include protuberances and other irregularities that must be negotiated. Very frequently, a step-type bend is required, wherein a straight length of conduit is bent twice such that the end portions of the conduit are parallel but offset. This is commonly referred to as an "offset bend." It will be appreciated that an offset bend typically requires two equal and opposite bends in the conduit.

When the conduit must be bent to generally go around or over an obstacle in an otherwise linear path, two complementary offset bends are made, producing what is commonly called a "saddle bend." A saddle bend generally requires four bends in the conduit, which bends are all equal, with two bends opposite in direction to the other two bends.

Often a number of parallel runs of conduit are required. In such cases, it is desirable that the offset bends for all of the parallel runs be very nearly identical, in order to have an easily followed and aesthetically pleasing result. Producing a good, consistent offset bend, however, requires practice, and can be difficult and time-consuming even for experienced installers. Moreover, if an error is made in an offset bend or saddle bend, the conduit may be rendered unusable.

With a conventional bender, a mechanic in the trade typically bends one end of the pipe a selected amount, and then calculates the appropriate the location and angular amount for a second bend that must be accomplished to achieve a specified offset, while accounting for the "conduit shrinkage" caused by the bent portion of the conduit. This is a time-consuming process and can be less than a science. It may take hundreds of hours to learn the skill to make a good offset bend. Another problem with conventional benders is that if the pair of bends are not appropriately aligned, i.e., precisely at 180 degrees opposite, you get what is called a "dog leg," wherein the offset end is not parallel to the starting end. Even when everything is done right and efficiently, it simply takes time to carefully produce two separate bends in a conduit.

A conventional conduit bender includes a conduit shoe having a curved groove that is sized generally to receive the conduit, and a ring or hook element near the end of the groove that is adapted to hold the end of the conduit in alignment during the bending process. An example of a conduit shoe is disclosed in U.S. Pat. No. 4,269,056 to Kozinski. As disclosed by Kozinski, the conduit shoe, or conduit bender, has a rocker base portion formed by a pair of laterally spaced, curved sidewalls that define a longitudinally extending conduit-receiving groove therebetween. A hook is formed at one end of the rocker base portion. Other suitable, somewhat similar conduit shoe members for bending conduit are in common use and are well known in the field. Such suitable shoes are simply referred to as "conduit shoes" herein.

It will also be appreciated that, although the present invention is described with reference to conduit, it is also suitable for producing offset bends—including, for example, saddle bends—in other tubular materials or other materials, such as metal pipe for water, gas, or the like. Producing such bends in other tubular materials may be particularly important in applications where space is tight and/or the desired routes for such materials are not straight and/or regular, such as in boats, ships, and other vehicles. It should be understood that the term "conduit," as used herein, includes any metal tubular or other-shaped material and, in particular, is not restricted to tubing used for housing wiring.

Although devices for producing offset bends in one step in pipe, conduit, and other materials have been proposed, prior art offset benders have one or more disadvantages. For example, they often are not suitable for producing large offset bends (over one inch) in a single step; they may require mechanical assistance and/or leverage; they cannot accommodate different-sized materials; they often are large and difficult to transport to a construction site; they can be difficult to use; they may not permit easy removal of the bent pipe or conduit; and may not produce repeatable or sufficiently accurate offset bends.

While conventional offset benders may be suitable for the particular purpose to which they address, they are not as suitable for speed and accuracy in offsetting pipe or other materials. In these respects, the one-step offset bender, according to the present invention, substantially departs from the conventional concepts and designs of the prior art, and in so doing, provides an apparatus primarily developed for the purpose of improving speed, accuracy, and portability in offsetting pipe or other materials.

SUMMARY OF THE INVENTION

In view of the foregoing disadvantages inherent in the known types of offset benders now present in the prior art, the present invention provides a new one-step offset bender construction wherein the same can be utilized for speed and accuracy in offsetting pipe or other materials.

The general purpose of the present invention, which will be described subsequently in greater detail, is to provide a new one-step offset bender that has many of the advantages of conventional conduit benders and novel features that result in a new one-step offset bender that is easy to use, easy to manufacture, and easily transportable.

To attain this, the present invention generally comprises: (i) a base; (ii) a first shoe support; (iii) a first shoe assembly attached to the first shoe support, the first shoe assembly including at least one conduit shoe; (iv) a second shoe support that is movable horizontally with respect to the first shoe support; and (v) a second shoe assembly that is movable vertically with respect to the first shoe assembly, the second shoe assembly including at least one conduit shoe. The conduit shoes include a curved radius with a curved groove and a hook arm, as are known in the art, that hold one end of the conduit in a substantially horizontal position.

In the preferred embodiment, each shoe assembly includes a plurality of shoes of differing sizes that are pivotally and lockably mounted to the supports, allowing the user to easily select a desired size.

In the preferred embodiment, the frame includes a horizontal rail that movably supports the second shoe support, and the second shoe assembly is mounted on a vertical rail, whereby the second shoe assembly may be moved generally toward and away from the first shoe assembly, and may be moved vertically with respect to the first shoe assembly.

In another aspect of the preferred embodiment, two or more different sized conduit shoes are mounted on opposite ends of a shaft to allow the shoe size to be changed by pulling a pin and spinning the arm 180 degrees and replacing the pin. A single set of shoes may be used with different sized.

In yet another embodiment of the invention, a motor is used to provide motive power for vertically moving the second shoe assembly. The motive power may be provided with and electric motor, hydraulically, or the like.

In this respect, before describing one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object of the present invention is to provide a one-step offset bender for speed and accuracy in offset bending of pipe or other materials.

Another object of the present invention is to provide a one-step offset bender that makes a straight or true offset in a pipe, conduit, or flat stock in one bend. One of the problems to overcome was that the overall length gets shorter as the material is bent.

Another object is to provide a one-step offset bender that will save time on the job. It may incorporate a built-in guide, so one can read the guide instead of getting out a measuring tape.

Another object is to provide a one-step offset bender that will provide a more uniform outcome on parallel runs of pipe.

Another object is to provide a one-step offset bender that, for smaller uses, could be transported and handled by one person, put in a truck, and used on a small site.

Other objects and advantages of the present invention will become obvious to the user, and it is intended that these objects and advantages are within the scope of the present invention.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
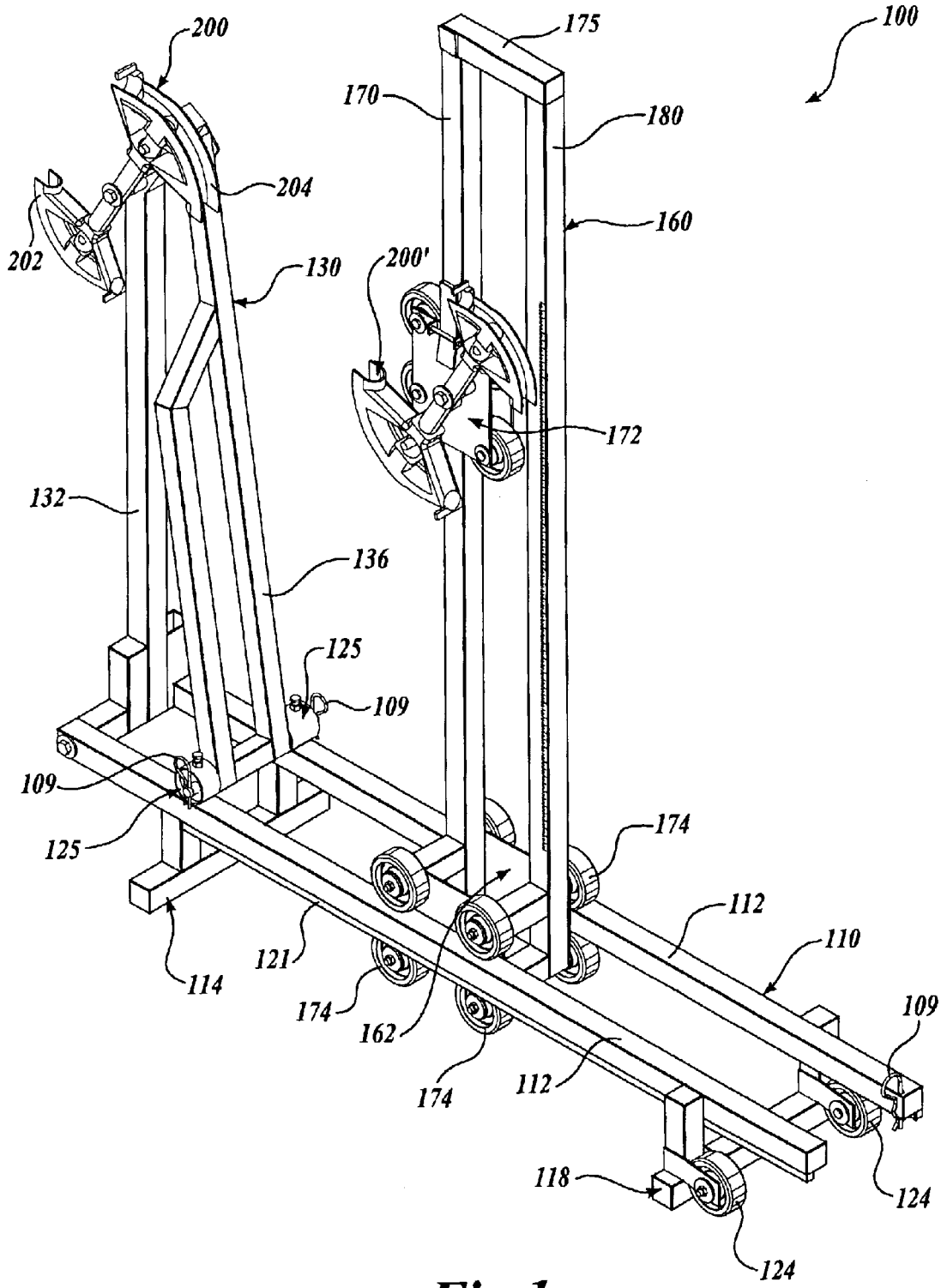
FIG. 1 is a perspective view of a first embodiment of an offset bender according to the present invention.

A currently preferred embodiment of the present invention will now be described, with reference to the figures, wherein like reference characters denote like elements. Referring now to FIG. 1, a one-step offset bender 100 according to the present invention is depicted. The major components of the offset bender 100 are a generally horizontal base 110, a fixed shoe support 130 that supports a first shoe assembly 200, and a traveling shoe support 160 that supports a second shoe assembly 200'.

Figure 2:
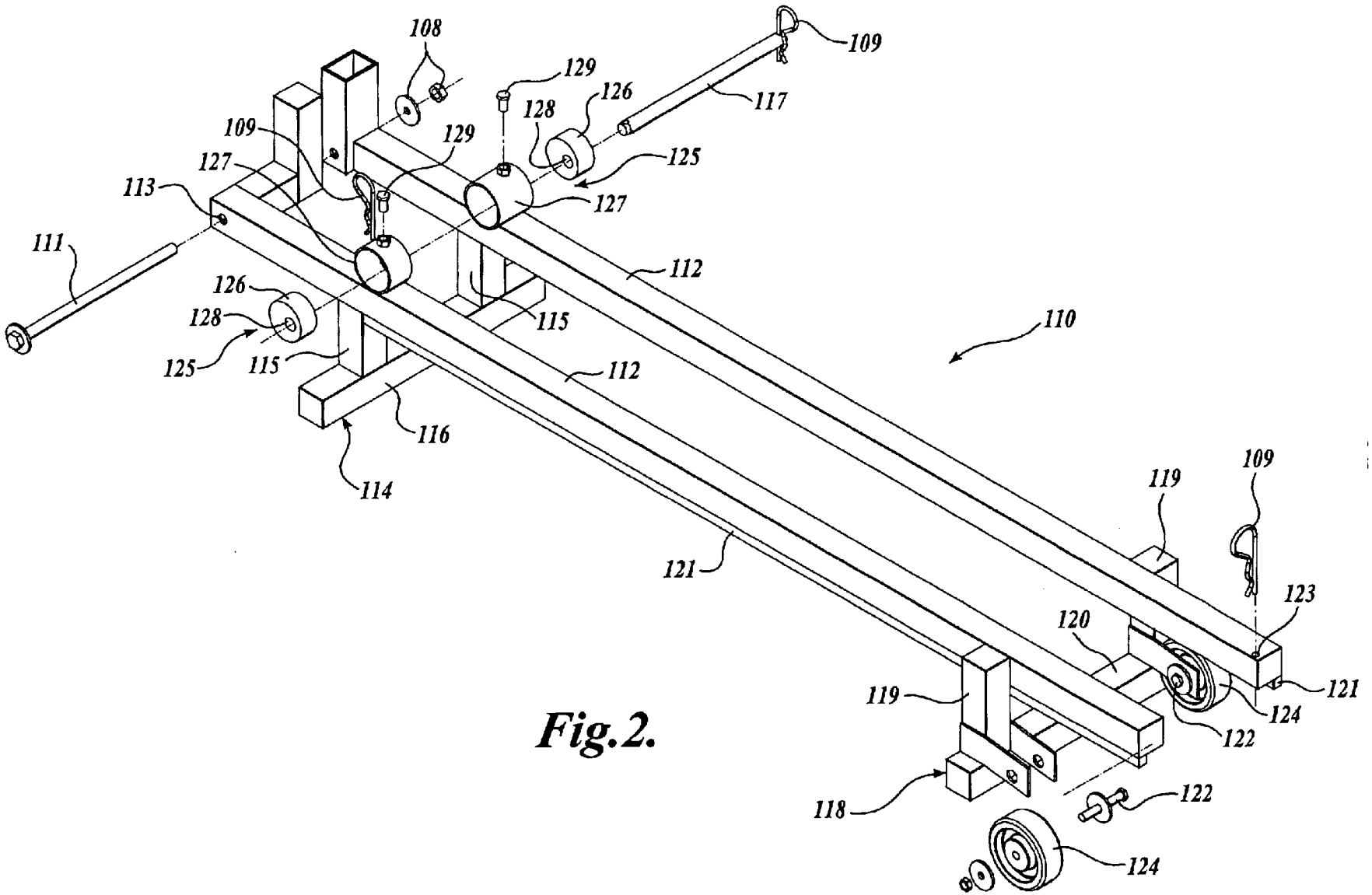
FIG. 2 is a partially-exploded perspective view of the base of the offset bender shown in FIG. 1.
Figure 5:
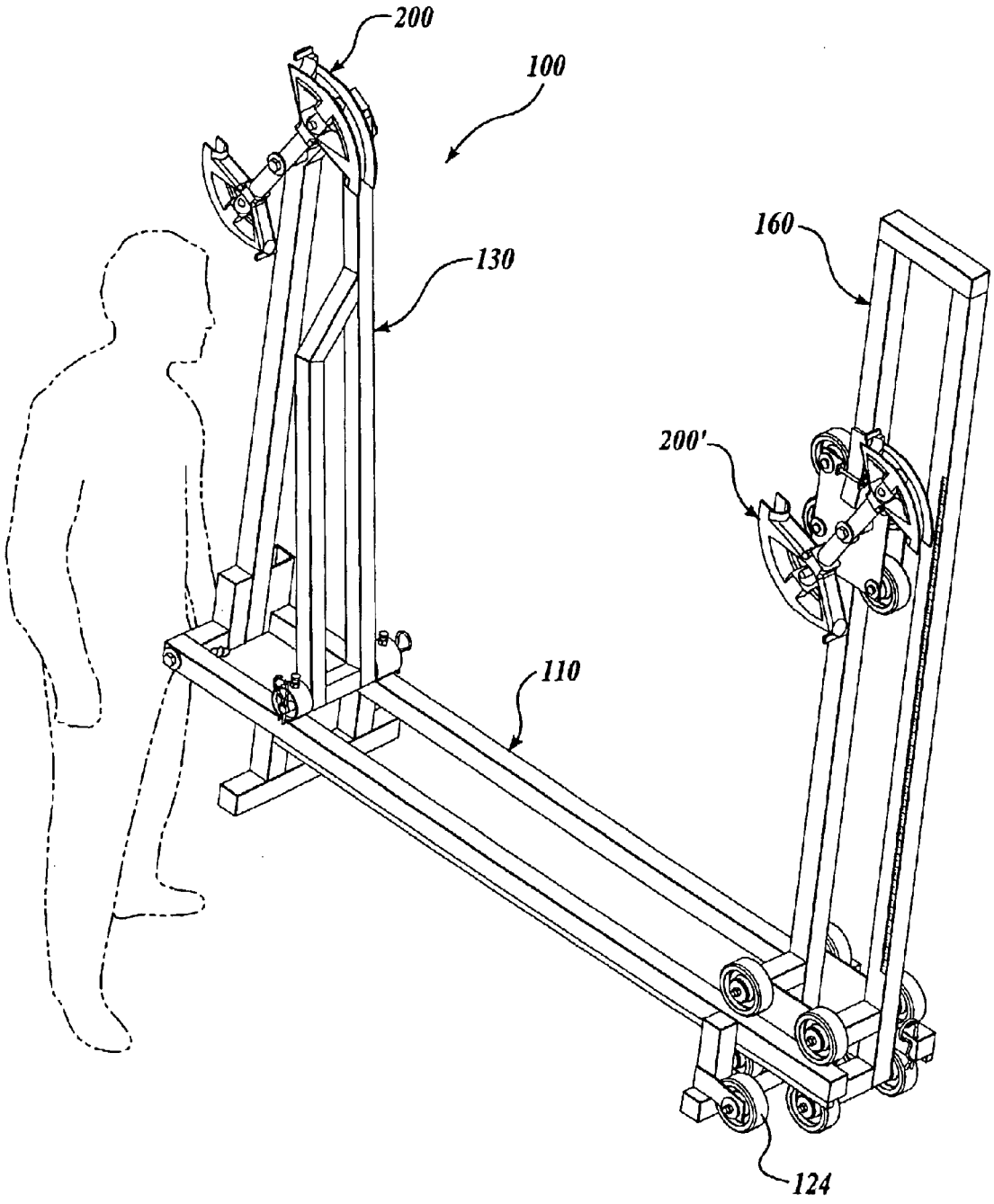
FIG. 5 is a perspective view of the offset bender shown in FIG. 1, showing a user moving the offset bender on its wheels.

Referring now to FIG. 2, a partially-exploded perspective view of the base 110 of this embodiment is shown. The base 110 includes a pair of generally horizontal, parallel rails 112 supported by a front leg assembly 114 and a rear leg assembly 118. The rails 112 include outboard longitudinal guides 121 disposed on the bottom of the rails 112. The front leg assembly 114 includes a transverse member 116 and two short vertical supports 115 that extend upwardly from the transverse member 116, and fixedly attach to the bottom of a corresponding rail 112. The rear leg assembly 118 includes a transverse member 120 and two vertical supports 119 that attach to the outboard sides of each rail 112. A pair of wheels 124 are rotatably attached to the rear leg assembly 118 with axles 122, and are positioned such that the transverse members 116, 120 rest securely on the ground when the offset bender 100 is positioned as shown in FIG. 1—but the base 110 can be lifted from the forward end to allow the wheels 124 to engage the ground, whereby the offset bender 100 can be easily moved about on the wheels 124, as shown in FIG. 5. A removable locking pin 109 is insertable into the locking pin aperture 123 on the base 110.

A first pivot aperture 113 is provided near the front end of the base 110 and a pivot or rod 111 is slidably inserted through the pivot aperture 113 after properly positioning the fixed shoe support 130 (see FIG. 1) to attach the fixed shoe support 130 to the base 110. Fastening hardware 108 secures the rod 111 in place.

Transversely aligned locking cam assemblies 125 are attached to each rail 112. The locking cam assembly 125 includes a disk 126 rotatably disposed in a metal hoop 127, the disk 126 having a cam aperture 128 near the edge of the disk 126. A setscrew 129 is provided through the metal hoop 127 to lock the disk at a desired orientation. A rod 117 is slidably inserted through the cam apertures 128 to releasably attach the fixed shoe support 130 (see FIG. 1) to the base 110. A pair of locking pins 109 secures the rod 117 in place.

Figure 3:
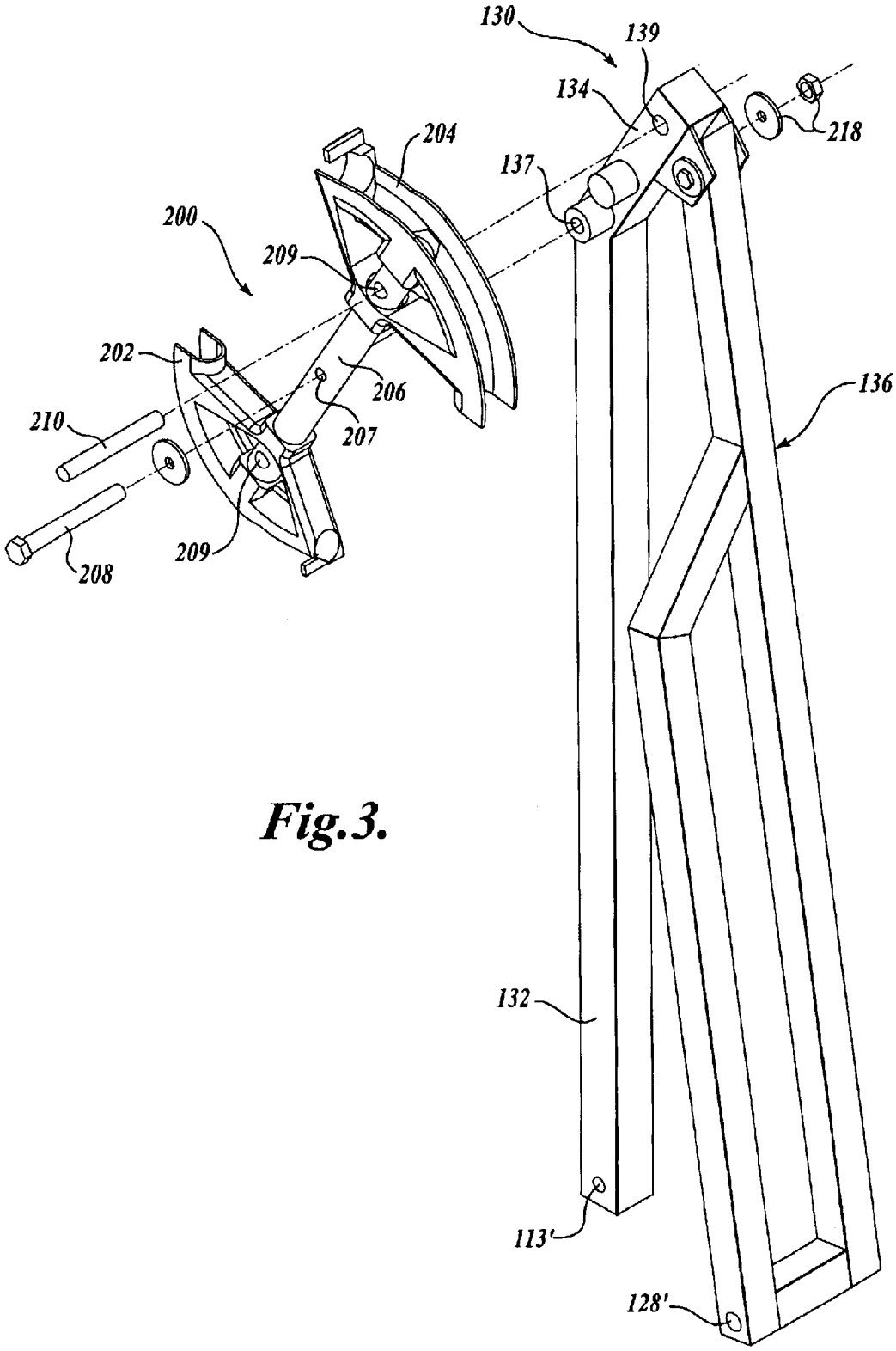
FIG. 3 is a partially-exploded perspective view of the fixed shoe support of the offset bender shown in FIG. 1.

Referring now to FIG. 3, a partially-exploded view of the fixed shoe support 130 is shown. The fixed shoe support 130 includes a first arm 132 pivotally connected to a second arm 136. The first arm 132 is adapted to be pivotally attached to the base 110 with the pivot rod 111 (see FIG. 2) through pivot aperture 113'. The first arm 132 is pivotally attached to the second arm 136 at the opposite end. The first arm 132 includes an angled portion 134 is provided near the top of the first arm 132 to accommodate the first shoe assembly 200, discussed in detail below. The second arm 136 is pivotally attached to the first arm 132 at one end, and is adapted to releasably engage the locking cam assemblies 125 (see FIG. 1) at the cam apertures 128 (see FIG. 2) through aperture 128', such that the first and second arms 132, 136 form an inverted V-shaped support.

The first shoe assembly 200 is pivotally attached near the top of the first arm 132 of the fixed shoe support 130. The first shoe assembly 200 includes a first conduit shoe 202 and a second conduit shoe 204 mounted on opposite ends of a conduit shoe shaft 206. The first and second conduit shoes 202 and 204 are of different sizes and, in the preferred embodiment, the first conduit shoe 202 is sized to bend ½-inch EMT conduit, and the second conduit shoe 204 is sized to bend ¾-inch EMT conduit, although it will be readily apparent that conduit shoes of different sizes could alternatively be used. The first shoe assembly 200 is pivotally attached to the first arm 132 with a pivot rod 208 that passes through an aperture 207 centrally disposed in the conduit shoe shaft 206 and through a corresponding aperture 137 in the fixed shoe support 130. The pivot rod 208 may be held in place with conventional fastening hardware 218. A pair of locking apertures 209 is provided, one near each end of the conduit shoe shaft 206, that is positionable over a corresponding locking aperture 139 in the fixed shoe support 130, such that a locking pin 210 can be inserted to rotationally lock the first shoe assembly 200 in either of two positions. For example, when the first shoe assembly 200 is locked in the first position, the user can remove the locking pin 210, spin the first shoe assembly 200 by 180 degrees, and re-insert the locking pin 210 to lock the first shoe assembly in a second position.

It should now be appreciated that the first shoe assembly 200 provides two different-sized conduit shoes 202, 204, and that the user can selectively lock either shoe into the desired position, depending on the size of conduit to be bent. It is also contemplated that with minor modifications that would be obvious to persons of ordinary skill in the art, more than two different sized conduit shoes could be incorporated into the first shoe assembly. Alternatively, the first shoe assembly 200 may be removably attached to the fixed shoe support 130, whereby a user could select from a variety of different shoe assemblies to accommodate a particular application and conduit size. For example, conduit shoes having a different bend radii may be desired for a particular application.

The purpose of the cam assemblies 125 should now be clear. The off-center cam apertures 128 in the lockable, rotatably mounted disks 126 permit user to selectively adjust, or fine tune, the position of the first shoe assembly 200 to permit very accurate conduit bending to be accomplished. Although the cam assemblies 125 are shown, it will be readily apparent that other adjustment means, such as a sliding bar assembly or the like, may alternatively be used to permit accurate positioning of the first shoe assembly 200.

Figure 4:
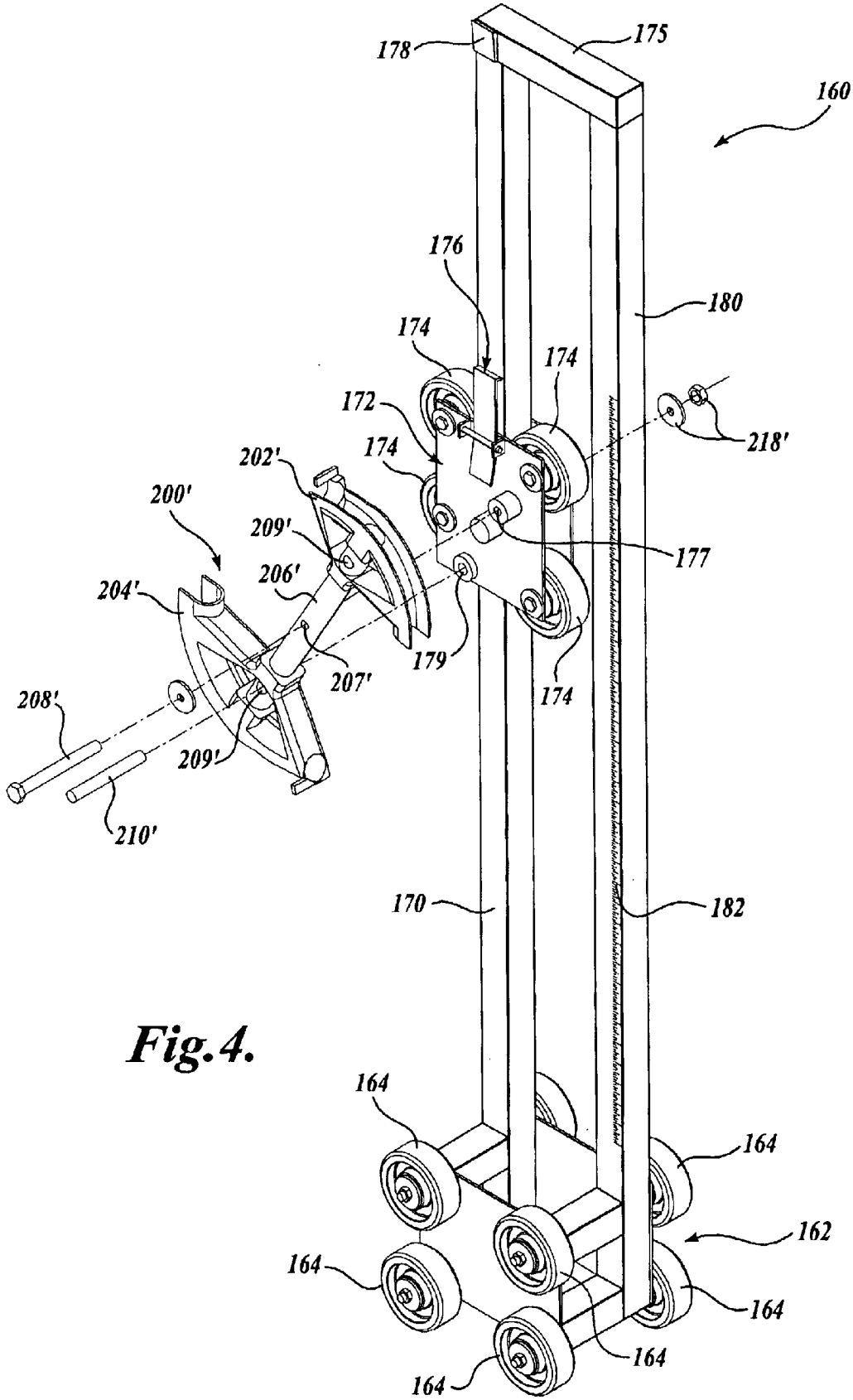
FIG. 4 is a partially-exploded perspective view of the movable shoe support of the offset bender shown in FIG. 1.

Referring now to FIG. 4, a partially-exploded view of the traveling shoe support 160 is shown. The traveling shoe support 160 includes a truck assembly 162 that engages the rails 112 of the base 110 (see FIG. 1). In the disclosed embodiment, the truck assembly 162 includes sets of four wheels 164 arranged on each side of the traveling shoe assembly 160. Each set of four wheels 164 includes two upper and two lower wheels 164, the upper and lower wheels spaced to receive one of the rails 112 therebetween. The traveling shoe support 160 is therefore supported by the rails 112, and can move back and forth along the rails 112. In particular, the traveling shoe support 160 can move toward, and away from, the fixed shoe support 130. It will be apparent from FIG. 1, that the truck assembly 162 is maintained centered on the rails 112 by the outboard longitudinal guides 121. Although the preferred truck assembly utilizes wheels 164 to move along the rails 112, it is also contemplated that alternative mechanisms to allow translation could alternatively be used, such as a slide or a geared assembly.

A first upright member 170 extends upwardly from the truck assembly 162. A wheeled platform 172 is movably disposed on the first upright member 170, the wheeled platform 172 having four wheels 174 that are spaced to receive the first upright member 170 therebetween. The wheeled platform 172 can move vertically, guided by the first upright member 170. A second shoe assembly 200' is movably disposed on the wheeled platform 172. The second shoe assembly 200' can therefore move horizontally along the rails 112 by moving the entire traveling shoe support 160, and can move vertically along the upright member 170. The second shoe assembly 200' is preferably identical to the first shoe assembly 200 and, in particular, includes conduit shoes 202' and 204' connected with a conduit shoe shaft 206' and pivotally attached to the wheeled platform 172 with a pivot rod 208' disposed through the apertures 207' and 177 and attached with the fastening hardware 218'. A removable locking pin 210' is provided to lock the second shoe assembly 200' in either of two positions that are 180 degrees rotated, through one of the second shoe assembly 200' apertures 209' and aperture 179 in the wheeled platform 172. A biased latch assembly 176 is attached to the wheeled platform 172, and a corresponding catch 178 is provided at the top of the first upright member 170, such that the wheeled platform 172 can be releasably latched near the upper end of the first upright member 170.

A second upright member 180 also extends upwardly from the truck assembly 162, generally parallel to the first upright member. The second upright member 180 preferably includes a gauge or measuring apparatus 182 that is positioned to have zero aligned with the top of the conduit shoe 202 or 204 on the first shoe assembly 200, such that the top of a conduit (not shown) inserted for bending in the offset bender 100 (see FIG. 6) will be positioned at the top of the measuring apparatus 182. A cross support 175 connects the first and second upright members 170, 180 at the top for strength and stability.

Figure 6:
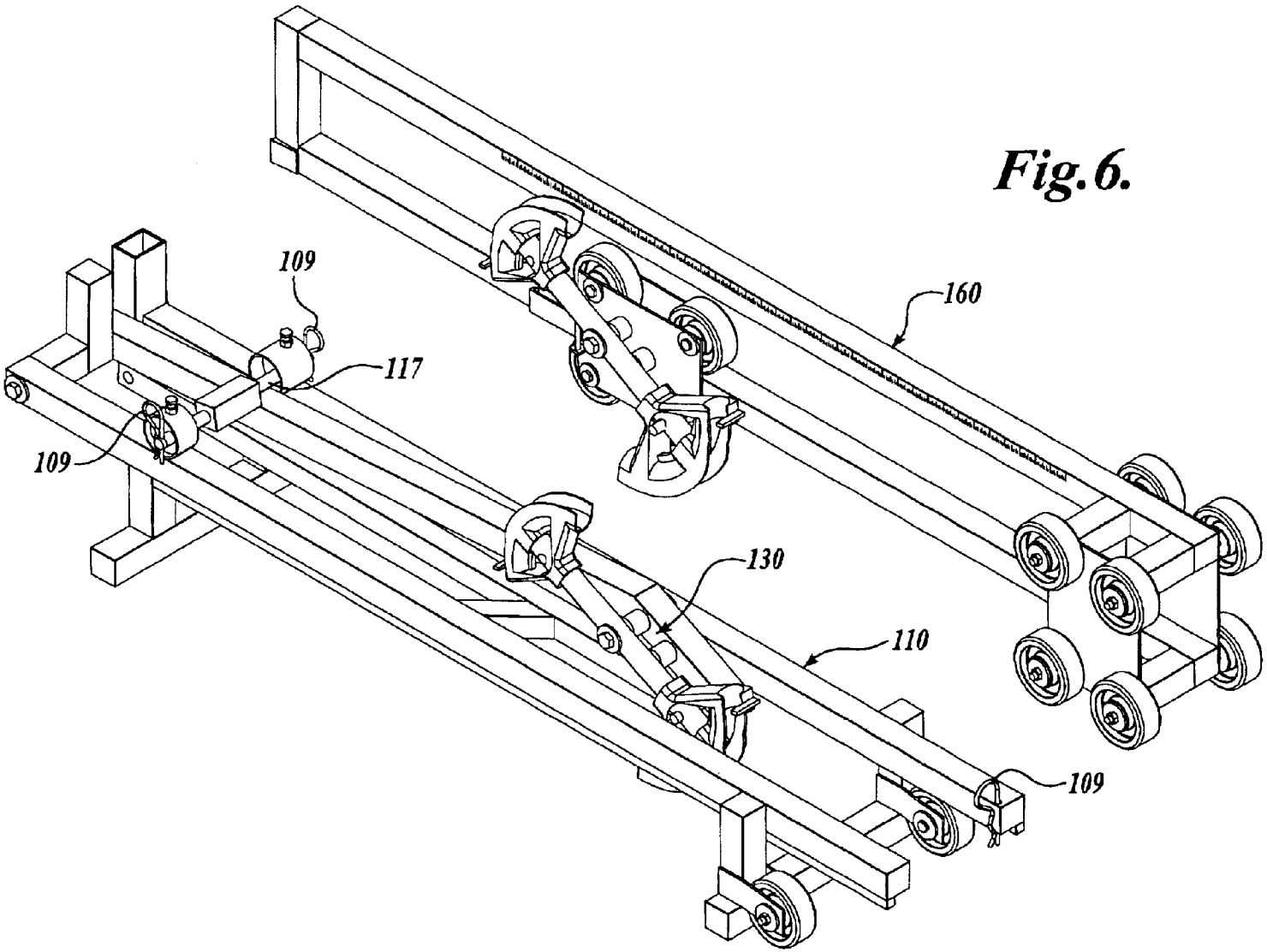
FIG. 6 is a perspective view of the offset bender shown in FIG. 1, shown disassembled and folded for transport.

Referring again to FIG. 1, it will now be appreciated that the fixed shoe support 130 is pivotally attached near one end of the base 110, and also releasably attached to the locking cam assemblies 125. The traveling shoe support 160 is rollably mounted on the rails 112, such that it can move toward or away from the fixed shoe support 130. The removable locking pin 109 at the far end of the base 110 prevents the traveling shoe support 160 from disengaging from the base 110. The offset bender 110 is therefore easily foldable, as shown in FIG. 6 (as compared with FIG. 1). The user simply removes the locking pin 109 near the far end of the base 110 and rolls the traveling shoe support 160 off of the base 110. Then user then removes the locking pins 109 at each locking cam assembly 125 and removes the rod 117, to release the second arm 136 of the fixed shoe support 130 from the base 110. The entire fixed shoe support 130 can then pivot toward the base 110. (The rod 117 and locking pins 109 are shown reinserted into their respective apertures for convenient access.) The offset bender 110 can therefore be easily folded for transporting to the work site.

Figure 7A:
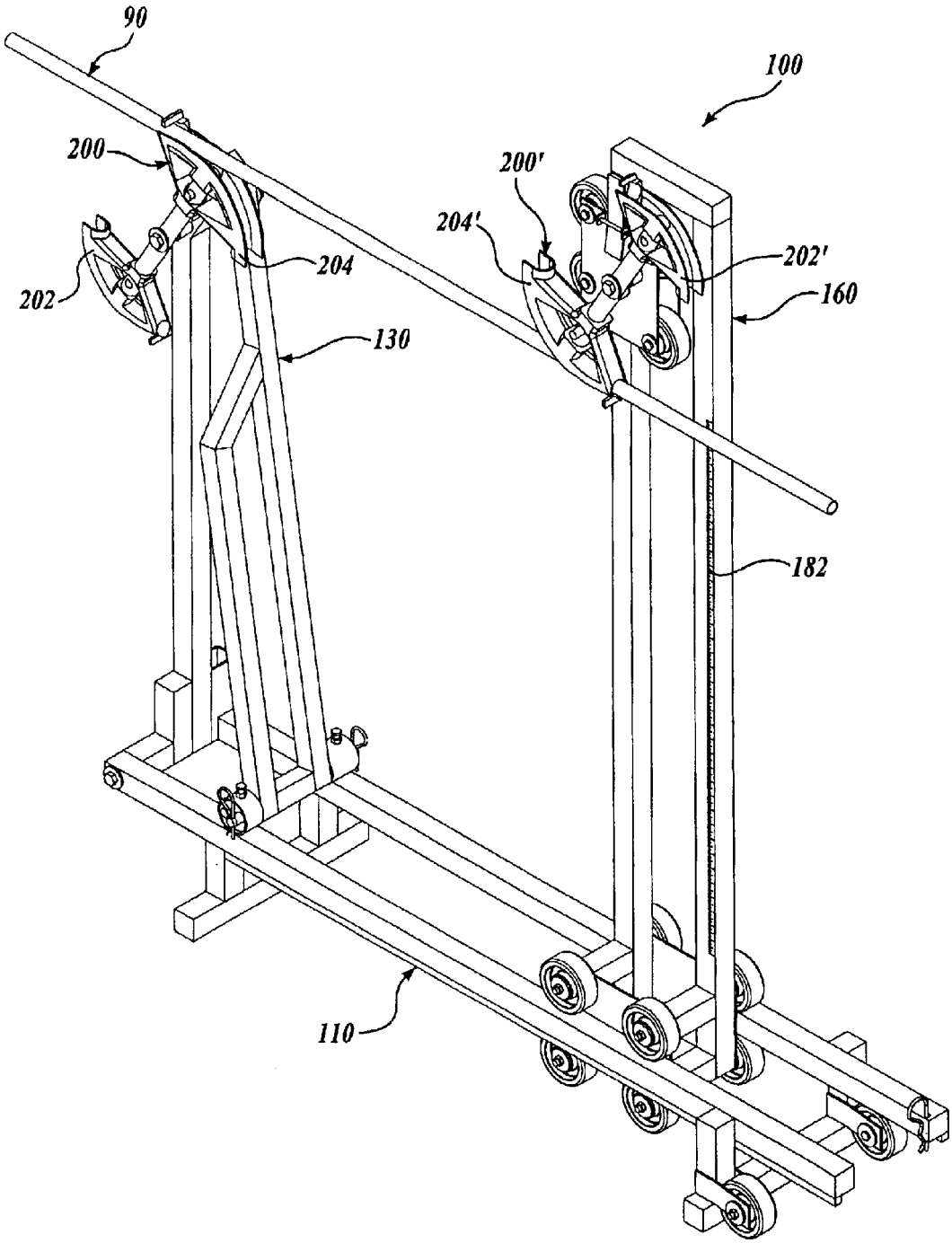
FIG. 7A is a perspective view of the offset bender shown in FIG. 1, with a length of conduit inserted, in position for bending.
Figure 7B:
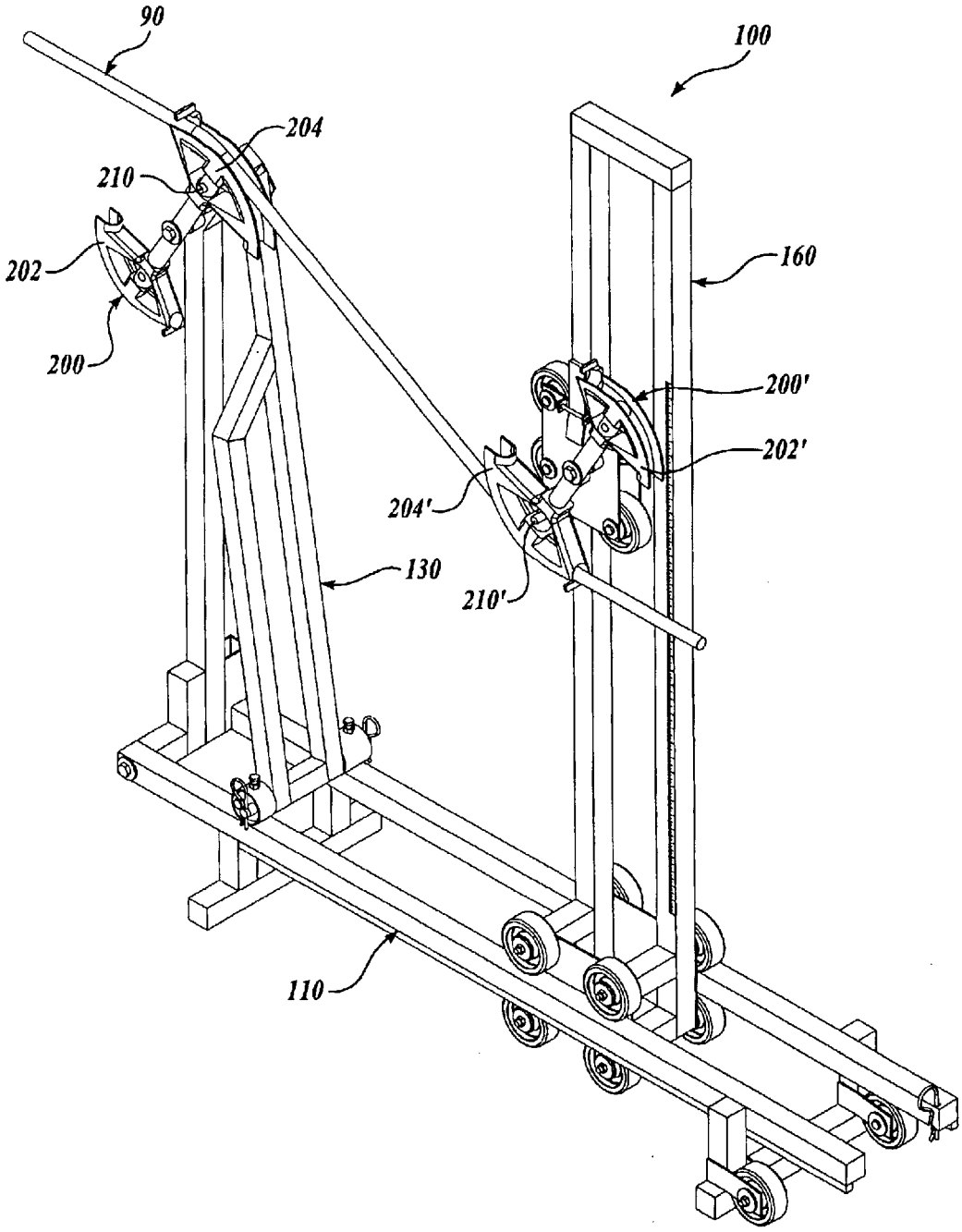
FIG. 7B is a perspective view of the offset bender shown in FIG. 7A, after an offset bend has been made in the length of conduit.

The operation of the offset bender 100 for bending pipe or conduit 90 will now be described, with reference to FIGS. 7A and 7B. FIG. 7A shows the offset bender 100 with a length of unbent conduit 90 properly inserted into the second conduit shoe 204 of the first shoe assembly 200, and into the second conduit shoe 204' of the second shoe assembly 200'. The traveling shoe assembly 160 is pre-positioned such that the distance between the second conduit shoes 204 and 204' is at the desired spacing (often called the "star-to-star" length) for the offset bend.

The top of the conduit 90 prior to bending is disposed near the top of the measurement apparatus 182. The conduit 90 is now in position for receiving an offset bend. The user simply pulls down on the second shoe assembly 200' until the desired bend has been achieved, as shown in FIG. 7B. The desired offset bend is easily determined by looking at the end of the conduit 90 near the measuring apparatus 182 and pulling the second shoe assembly 200' until the desired offset is achieved. It can be seen by comparing FIGS. 7A and 7B, that the traveling shoe support 160 must move towards the fixed shoe support 110 during the bend to accommodate the "shrinkage" or loss of longitudinal length resulting from the bend in the conduit 90. It will be appreciated that if a different diameter conduit must be bent, the user can simply pull the locking pins 210, 210' from the respective first and second shoe assemblies 200, 200', spin the shoe assemblies 200, 200' by 180 degrees, and reinsert the locking pins 210, 210'. Also it should be appreciated that the user can produce a single bend in the conduit 90 by inserting the conduit in the shoe 204 of the first shoe assembly 200 and pulling down on the end of the conduit, or moving the second shoe assembly 200' downwardly on the conduit without inserting the conduit into the shoe 204'.

It is also contemplated that a lever means (not shown) may be provided between the first and second shoe assemblies 200, 200' to facilitate bending the conduit 90. For example, a pair of eye screws (not shown) may be installed on the first and second shoe assemblies 200, 200' such that a length of pipe or rod (not shown) may be inserted through the eye screws to gain mechanical leverage for pulling down on the second shoe assembly 200'.

Figure 8:
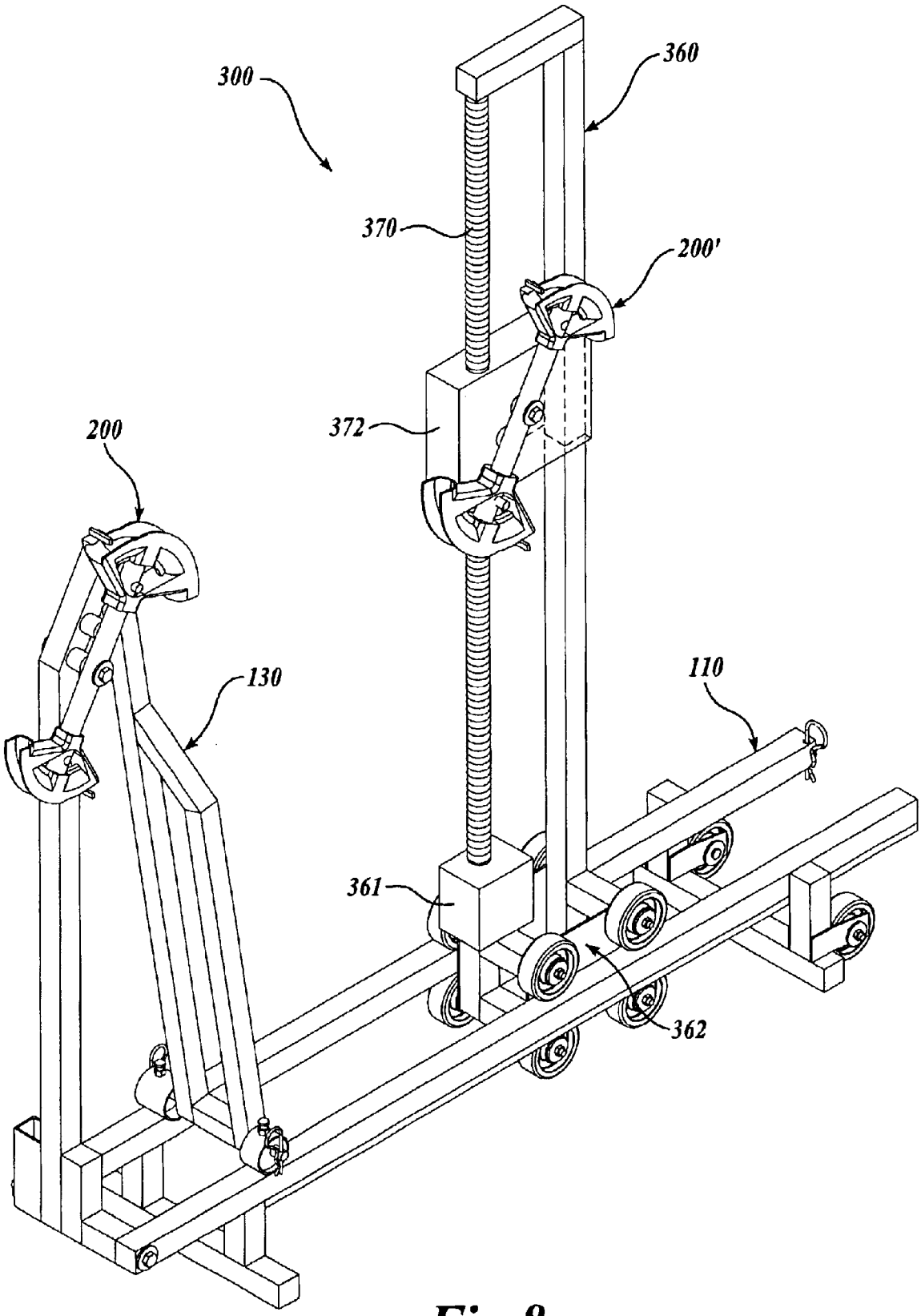
FIG. 8 is a perspective view showing a second embodiment of an offset bender according to the present invention, wherein a motor drive is coupled to the movable shoe assembly.

An alternative embodiment of an offset bender 300 according to the present invention is shown in FIG. 8. The offset bender 300 is substantially identical to the offset bender 100 described above, except as discussed below. For brevity a description of the common elements is not repeated here. The first upright member 370 of the traveling shoe support 360 is a motor-driven screw, driven by a motor 361 disposed on the truck assembly 362. The second shoe assembly 200' is attached to a movable platform 372 that engages the motor-driven screw 370 and is guided by the vertical member of the traveling shoe support 360, such that operation of the motor 361 will cause the motor-driven screw 370 to turn, thereby moving the movable platform 372 and the second shoe assembly 200' up or down, depending on the direction the screw 370 is turned. This embodiment of the offset bender 300 provides a power assist to the user for bending the pipe or conduit, and therefore is particularly suitable for bending very stiff tubing and for applications where a lot of bends must be made, wherein a user may become fatigued from manually bending the tubing. Although a straightforward power-assisted apparatus is shown, it will be readily apparent that other power assist mechanisms, as are well-known in the art, may alternatively be used. For example, the moving platform 372 may be mounted with geared, motor-driven wheels that engage corresponding teeth on an upright member, or pneumatic or hydraulic powered systems may be utilized. For larger pipe, a power-driven ram, screw, gear, sprockets, and chain, or other power assist element may be used to facilitate bending the pipe.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A conduit offset bender for bending a length of conduit, the conduit offset bender comprising:

(a) a base having a proximal end and a distal end, the base having a horizontal rail;

(b) a first shoe support having a bottom portion attached to the proximal end of the base, and a top portion;

(c) a first shoe assembly attached to the proximal portion of the first shoe support, the first shoe assembly including a first conduit shoe with a curved groove that is adapted to engage a length of conduit;

(d) a second shoe support that movably engages the horizontal rail of the base such that the second shoe support is movable horizontally along the horizontal rail, the second shoe support having a vertical member; and (e) a second shoe assembly that engages the vertical member such that the second shoe assembly is movable vertically along the vertical member, the second shoe assembly having a second conduit shoe with a curved groove that is adapted to engage the length of conduit.

2. The conduit offset bender of claim 1, wherein the second shoe support includes a wheeled truck assembly that engages the horizontal rail.

3. The conduit offset bender of claim 2, wherein the base includes two parallel horizontal rails, each rail having a longitudinal guide, and wherein the wheeled truck assembly is centered on the rails by the longitudinal guides.

4. The conduit offset bender of claim 3, wherein the second shoe assembly further includes a wheeled platform that movably engages the vertical member of the second shoe support.

5. The conduit offset bender of claim 1, wherein the first shoe assembly and the second shoe assembly each comprises a plurality of conduit shoes of different sizes, and wherein the first shoe assembly is pivotally attached to the first shoe support, and the second shoe assembly is pivotally attached to the second shoe support, and wherein the first and second shoe assemblies are lockable in at least two different positions.

6. The conduit offset bender of claim 1, wherein the base further comprises wheel means at the base distal end to facilitate moving the conduit offset bender.

7. The conduit offset bender of claim 6, wherein the first shoe support comprises a first arm having a proximal end pivotally attached to the base and a distal end, a second arm having a proximal end pivotally attached to the distal end of the first arm, and a distal end releasably attachable to the base, whereby the first shoe support is foldable, and further, wherein the second shoe support is separable from the base.

8. The conduit offset bender of claim 1, further comprising a motor that is attached to the second shoe assembly, wherein the motor is operable to move the second shoe assembly vertically.

9. The conduit offset bender of claim 8, wherein the vertical member of the second shoe support is a screw member, and wherein the screw member threadably engages the second shoe assembly, the screw member being drivably connected to the motor.

10. An offset bender for making two bends in conduit, the conduit having first and second ends, comprising in combination:

(a) a base having a pair of generally horizontal rails;

(b) a fixed shoe support having a proximal end pivotably attached to the base such that the fixed shoe support is selectively positionable between a vertical position, wherein the fixed shoe support extends upwardly from the base, and a horizontal position, wherein the fixed shoe support is disposed generally along the base, the fixed shoe support also having a distal end;

(c) a first shoe assembly attached to the distal end of the fixed shoe support, the first shoe assembly having a conduit shoe adapted to receive the first end of the conduit;

(d) a traveling shoe support extending upwardly from the base, the traveling shoe support having a proximal end movably attached to the pair of horizontal rails such that the traveling shoe support is movable along the horizontal rails, and a distal end, the traveling shoe support further including a vertical member; and (e) a second shoe assembly attached to the vertical member of the traveling shoe support such that the second shoe assembly is movable between a first vertical position and a second vertical position, the second shoe assembly having a conduit shoe adapted to receive the second end of the conduit.

11. The offset bender of claim 10, wherein the traveling shoe support includes a wheeled truck assembly that engages the pair of horizontal rails of the base.

12. The offset bender of claim 11, wherein the pair of horizontal rails each includes a longitudinal guide, and wherein the traveling shoe support includes a wheeled truck assembly that is centered on the rails by the longitudinal guides.

13. The offset bender of claim 12, wherein the second shoe assembly includes a wheeled platform that movably engages the vertical member of the traveling shoe support.

14. The offset bender of claim 10, wherein the first shoe assembly and the second shoe assembly each comprise a plurality of conduit shoes of different sizes, and wherein the first shoe assembly is pivotally attached to the fixed shoe support, and the second shoe assembly is pivotally attached to the traveling shoe support, and wherein the first and second shoe assemblies are lockable in at least two different positions.

15. The offset bender of claim 10, wherein the base further comprises wheel means to facilitate moving the offset bender.

16. The offset bender of claim 15, wherein the fixed shoe support comprises a first arm having a proximal end pivotally attached to the base and a distal end, and a second arm having a proximal end pivotally attached to the distal end of the first arm, and a distal end releasably attachable to the base, whereby the fixed shoe support is foldable, and further wherein the traveling shoe support is separable from the base.

17. The offset bender of claim 10, further comprising a motor that is attached to the second shoe assembly wherein the motor is operable to move the second shoe assembly vertically.

18. The offset bender of claim 17, wherein the vertical member of the traveling shoe support is a screw member, and wherein the screw member threadably engages the second shoe assembly, the screw member being drivably connected to the motor.

19. An offset bender for simultaneously making two bends in conduit, the conduit having first and second ends, the offset bender comprising, in combination:

(a) a base having a horizontal track, a front end and a back end;

(b) a fixed shoe support pivotally attached to the front end of the base and lockable in an upright position with respect to the base, the fixed shoe support having an upper portion;

(c) a first shoe assembly attached to the upper portion of the fixed shoe support, the first shoe assembly having a conduit shoe adapted to hold the first end of the conduit in a horizontal orientation;

(d) a traveling shoe support having a truck portion that rollably engages the base horizontal track, the traveling shoe support further including a substantially vertical member extending upwardly from the truck portion; and (e) a second shoe assembly movably attached to the substantially vertical member such that the second shoe assembly is movable between a first vertical position relatively far from the base, and a second vertical position relatively close to the base, the second shoe assembly further having a conduit shoe adapted to hold the second end of the conduit in a horizontal orientation.

20. The offset bender of claim 19, wherein the horizontal track includes two parallel horizontal rails, each rail having a longitudinal guide, and wherein the truck portion of the traveling shoe support is centered on the rails by the longitudinal guides.

21. The offset bender of claim 20, wherein the second shoe assembly further includes a wheeled platform that movably engages the substantially vertical member of the traveling shoe support.

22. The offset bender of claim 19, wherein the first shoe assembly and the second shoe assembly each comprise a plurality of conduit shoes of different sizes, and wherein the first shoe assembly is pivotally attached to the fixed shoe support, and the second shoe assembly is pivotally attached to the traveling shoe support, and wherein the first and second shoe assemblies are lockable in at least two different positions.

23. The offset bender of claim 19, wherein the base further comprises wheel means attached to the base to facilitate moving the offset bender.

24. The offset bender of claim 23, wherein the fixed shoe support comprises a first arm having a proximal end pivotally attached to the base and a distal end, and a second arm having a proximal end pivotally attached to the distal end of the first arm, and a distal end releasably attachable to the base, whereby the fixed shoe support is foldable, and further wherein the traveling shoe support is separable from the base.

* * * * *